US008879976B2

(12) United States Patent
Fujiwara et al.

(10) Patent No.: US 8,879,976 B2
(45) Date of Patent: Nov. 4, 2014

(54) IMAGE FORMING AND ERASING APPARATUS AND IMAGE FORMING AND ERASING METHOD

(75) Inventors: Shigeru Fujiwara, Kanagawa (JP); Satoshi Kinouchi, Tokyo (JP); Ryota Saeki, Shizuoka (JP); Shoko Shimmura, Kanagawa (JP); Kazutoshi Takahashi, Shizuoka (JP); Toshihiro Sone, Kanagawa (JP); Takafumi Amano, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 434 days.

(21) Appl. No.: 13/291,338

(22) Filed: Nov. 8, 2011

(65) Prior Publication Data

US 2012/0141175 A1 Jun. 7, 2012

Related U.S. Application Data

(60) Provisional application No. 61/419,435, filed on Dec. 3, 2010.

(51) Int. Cl.
*G03G 15/20* (2006.01)
*G03G 15/00* (2006.01)

(52) U.S. Cl.
CPC ..... *G03G 15/6573* (2013.01); *G06G 15/6585* (2013.01); *G03G 15/6591* (2013.01)
USPC ..... 399/341

(58) Field of Classification Search
USPC ..... 399/341, 328, 330, 331, 333, 335, 329, 399/390, 391
See application file for complete search history.

(56) References Cited

U.S. PATENT DOCUMENTS

| | | | | |
|---|---|---|---|---|
| 6,014,531 | A * | 1/2000 | Ebata et al. | 399/69 |
| 7,283,758 | B2 | 10/2007 | Murakami | |
| 8,284,221 | B2 | 10/2012 | Taguchi | |
| 8,369,760 | B2 | 2/2013 | Yamamoto et al. | |

(Continued)

FOREIGN PATENT DOCUMENTS

| | | |
|---|---|---|
| CN | 101456280 | 6/2009 |
| CN | 101887230 | 11/2010 |
| CN | 101893832 | 11/2010 |
| JP | 2010-243595 | 10/2010 |

OTHER PUBLICATIONS

Chinese Office Action for Chinese Patent Application No. 201110397944.3 dated Mar. 3, 2014.

*Primary Examiner* — Billy Lactaoen
(74) *Attorney, Agent, or Firm* — Amin, Turocy & Watson, LLP

(57) ABSTRACT

An image forming apparatus according to an embodiment includes: an image erasing section including a first member which has an elastic layer and heats a recording medium having a thermally decolorizable toner image on the toner image side and a second member which erases the toner image by allowing the recording medium in cooperation with the first member; an image forming section which transfers a thermally decolorizable toner image onto the recording medium on which the toner image is erased to form an unfixed toner image; and an image fixing section including a third member which does not have an elastic layer and heats the recording medium on the unfixed toner image side and a fourth member which fixes the unfixed toner image by allowing the recording medium in cooperation with the third member.

17 Claims, 7 Drawing Sheets

(56) References Cited

U.S. PATENT DOCUMENTS

| | | | | |
|---|---|---|---|---|
| 2005/0141906 | A1* | 6/2005 | Murakami | 399/45 |
| 2006/0198649 | A1* | 9/2006 | Imamiya | 399/53 |
| 2007/0013472 | A1 | 1/2007 | Kobayashi et al. | |
| 2009/0154970 | A1 | 6/2009 | Yoshida et al. | |
| 2010/0196630 | A1* | 8/2010 | Murakami et al. | 428/32.39 |
| 2010/0215384 | A1* | 8/2010 | Yasutomi | 399/15 |
| 2010/0289861 | A1 | 11/2010 | Taguchi | |
| 2010/0296848 | A1 | 11/2010 | Yamamoto et al. | |
| 2012/0145023 | A1 | 6/2012 | Yoshida et al. | |
| 2013/0002785 | A1 | 1/2013 | Taguchi | |

* cited by examiner

IMAGE FORMING AND ERASING APPARATUS AND IMAGE FORMING AND ERASING METHOD

CROSS-REFERENCE TO RELATED APPLICATION

This application is based upon and claims the benefit of priority from provisional U.S. Patent Application 61/419,435 filed on Dec. 3, 2010, the entire contents of which are incorporated herein by reference.

FIELD

Embodiments described herein relate to an image forming apparatus using a toner which can be decolorized by heating and to an image forming and erasing method using the image forming apparatus.

BACKGROUND

Conventionally, in order to reduce the amount of $CO_2$ emission by reducing energy required for the recycling of paper and the production of paper by reusing paper, an image forming apparatus using a decolorizable toner which is decolorized by heating for forming an image by a known electrophotographic process and a decolorizing apparatus which heats paper having a decolorizable toner image formed thereon so as to change the image in a colored state to a decolorized state are proposed in the form of separate bodies.

However, in order to decolorize a toner image by a conventional decolorizing apparatus, for example, it was necessary to heat paper at 120 to 150° C. for about 2 hours, and there was a disadvantage that a large amount of electric power was required for erasing an image.

BRIEF DESCRIPTION OF THE DRAWINGS

The accompanying drawings, which is incorporated in and constitute a part of this specification, illustrates an embodiment of the invention and together with the description, serve to explain the principles of the invention.

DETAILED DESCRIPTION

Figure 1:
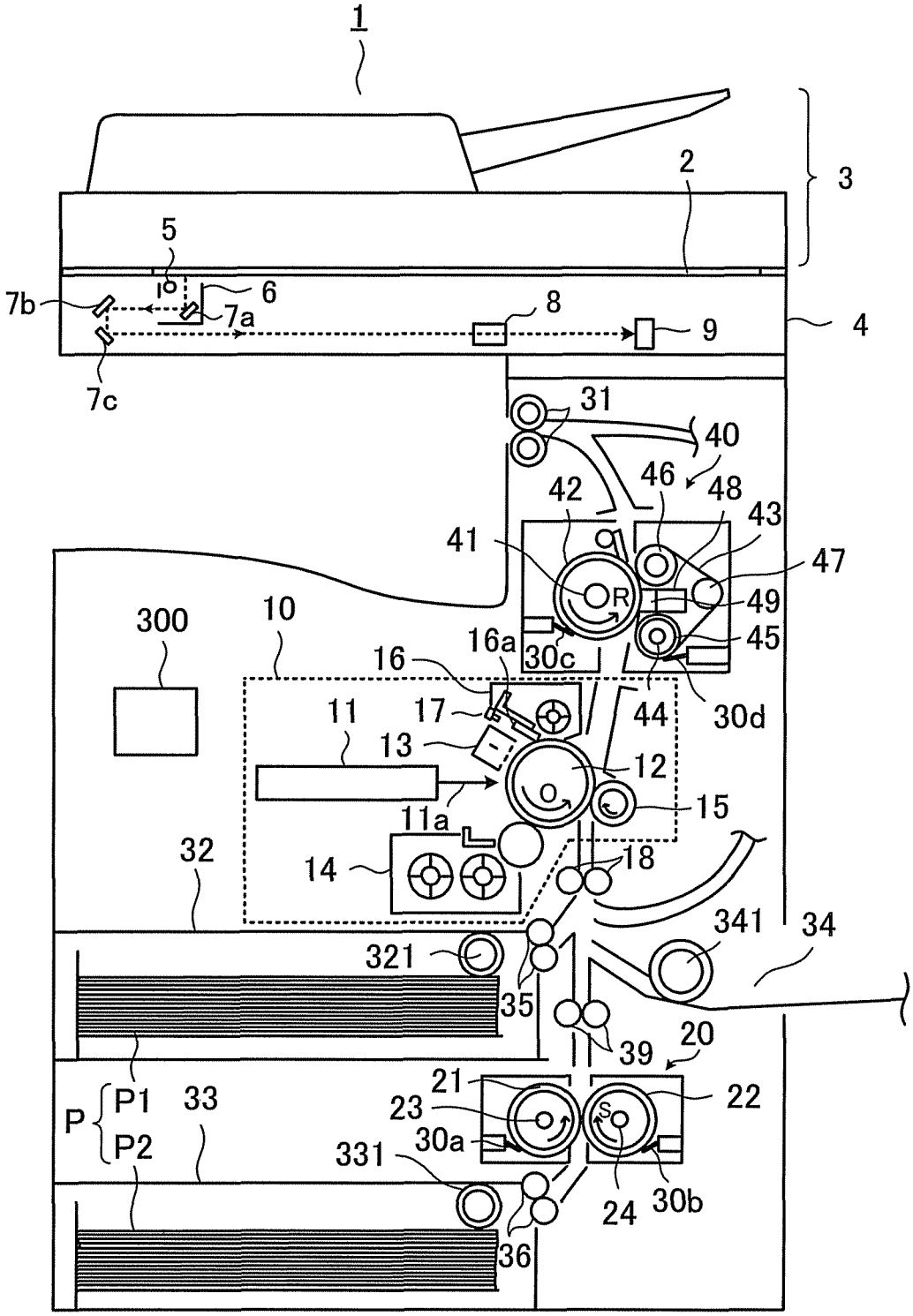
FIG. 1 is a schematic structural view of an image forming apparatus according to an embodiment.

Reference will now be made in detail to the present embodiment of the invention, an example of which is illustrated in the accompanying drawing.

An image forming apparatus according to an embodiment includes: an image erasing section including a first member which has an elastic layer and heats a recording medium having a thermally decolorizable toner image on the toner image side and a second member which forms a nip together with the first member and erases the toner image by allowing the recording medium to pass through the nip in cooperation with the first member; an image forming section which transfers a thermally decolorizable toner image onto the recording medium on which the toner image is erased to form an unfixed toner image; and an image fixing section including a third member which does not have an elastic layer and heats the recording medium on the unfixed toner image side and a fourth member which forms a nip together with the third member and fixes the unfixed toner image by allowing the recording medium to pass through the nip in cooperation with the third member.

Further, an image forming and erasing method according to an embodiment includes: allowing a recording medium having a thermally decolorizable toner image to pass through a nip formed by a first member which has an elastic layer and heats the recording medium on the toner image side and a second member which is in press-contact with the first member to erase the toner image; transferring a thermally decolorizable toner image onto the recording medium on which the toner image is erased to form an unfixed toner image; and allowing the recording medium to pass through a nip formed by a third member which does not have an elastic layer and heats the recording medium on the unfixed toner image side and a fourth member which is in press-contact with the third member to fix the unfixed toner image.

Further, an image forming apparatus according to an embodiment includes: an image forming section which transfers a thermally decolorizable toner image onto a recording medium to form an unfixed toner image; and an image fixing section including a third member which does not have an elastic layer and heats the recording medium on the unfixed toner image side and a fourth member which forms a nip together with the third member and fixes the unfixed toner image by allowing the recording medium to pass through the nip in cooperation with the third member.

Hereinafter, the embodiment will be described with reference to the accompanying drawings. Incidentally, when the same reference numeral is used in the following description, it means that elements assigned with the same reference numeral have the same structure and function.

FIG. 1 is a schematic structural view of an image forming apparatus according to this embodiment. As shown in FIG. 1, at an upper part of an image forming apparatus 1, an original document table 2 for placing an original document which is made of a transparent material such as a glass plate is provided. Further, an ADF (auto document feeder) 3 which continuously feeds an original document is openably and closably provided so as to cover the original document table 2. On the lower surface side of the original document table 2, a scanner 4 which optically reads an image of an original document placed on the original document table 2 is provided.

The scanner 4 includes, for example, a carriage 6 having a light source 5 which irradiates light to the original document table 2, reflecting mirrors 7*a*, 7*b*, and 7*c* which reflect the light of the light source 5 reflected from the original document, a variable magnification lens block 8 which magnifies the reflected light, and a CCD (charge coupled device) 9. The carriage 6 is reciprocatably provided along the lower surface of the original document table 2.

The carriage 6 moves forth while lighting the light source 5, so that the original document placed on the original document table 2 is exposed to light. The reflected light image of the original document by this light exposure is projected onto the CCD 9 via the reflecting mirrors 7*a*, 7*b*, and 7*c* and the variable magnification lens block 8.

The CCD 9 outputs a digitalized image signal corresponding to the projected reflected light image of the original document to an image processing circuit. This image signal is properly processed by the image processing circuit, and is then output to a laser unit 11 of an image forming section 10. The image forming section 10 executes an image forming process in which a toner image in accordance with the image signal output from the CCD 9 is formed on a recording medium P such as paper.

The image forming section 10 includes an image carrying member 12 having an organic photoconductor (OPC) on a surface thereof, a corona charger 13 for uniformly charging the surface of the image carrying member 12, the laser unit 11 for forming an electrostatic latent image on the image carrying member 12, a developing device 14 provided with a developing roller which supplies a developer to the electrostatic latent image on the image carrying member 12 and achieves development, a transferring roller 15, a cleaner 16 for removing and collecting a transfer residual toner or the like, and a charge eliminating lamp 17 for eliminating a charge from the surface of the image carrying member 12 after transfer.

The image carrying member 12 has an organic photoconductor (OPC) on a surface thereof and rotates at a peripheral speed of 136 mm/sec (the arrow O in FIG. 1). Around the image carrying member 12, along the rotational direction of the image carrying member 12, the corona charger 13, the laser unit 11, the developing device 14, the transferring roller 15, the cleaner 16, and the charge eliminating lamp 17 are disposed in this order.

The corona charger 13 is a scorotron corona charger and uniformly and negatively charges the image carrying member 12. The uniformly charged image carrying member 12 is subjected to scanning exposure to laser light 11*a* at a resolution of 600 dpi by a laser (semiconductor laser) mounted on the laser unit 11 in accordance with an image signal obtained by the scanner 4, and an electrostatic latent image is formed on the image carrying member 12.

The developing device 14 accommodates, for example, a two-component developer, which is composed of a mixture of decolorizable toner having a volume average particle diameter of from 5 to 12 μm and a magnetic carrier having a volume average particle diameter of from 30 to 80 μm and in which the decolorizable toner is negatively charged, and develops the electrostatic latent image on the image carrying member 12 to form a toner image. Incidentally, the developing device 14 is provided with a toner density sensor for detecting the density of the toner in the developer accommodated therein and the decolorizable toner is supplied from a toner cartridge to the developing device 14 in accordance with the detection output of the toner density sensor.

The transferring roller 15 is a conductive roller and a positive transfer bias is applied thereto by a high voltage power source. By the transferring roller to which the transfer bias is applied, the toner image formed on the image carrying member 12 is transferred onto a recording medium P which is fed from a paper feeding section 32, 33, or 34 and conveyed at a predetermined timing by a resist roller pair 18. The toner image transferred onto the recording medium P is fixed by the below-described image fixing section 40, and then the recording medium P is discharged to the outside of the apparatus by a paper discharging roller pair 31.

The cleaner 16 has a cleaning blade 16*a* which is in contact with the surface of the image carrying member 12 and scrapes off the toner remaining on the image carrying member 12 after transfer with the cleaning blade 16*a*. The charge eliminating lamp 17 eliminates a charge remaining on the surface of the image carrying member 12. The image carrying member 12 from which a charge is eliminated is used for forming the subsequent electrostatic latent image.

As the paper feeding section having a cassette, a paper feeding section 32 which accommodates unused paper P1 and a paper feeding section 33 which accommodates paper for reuse (paper having a fixed toner image) P2 are provided. Further, a manual paper feeding section 34 which feeds paper from the outside of the apparatus is provided. The apparatus is configured such that the selection of the paper feeding section can be performed from an operation panel, and paper is fed from the paper feeding section 32 or 33 by a pick-up roller 321 or 331 and a separating and conveying roller pair 35 or 36. Further, paper is fed from the manual paper feeding section 34 by a pick-up roller 341.

After a fixed toner image on the paper for reuse P2 fed from the paper feeding section 33 is erased by the below-described image erasing section 20, the paper for reuse P2 is conveyed to the image forming section 10 by a conveying roller pair 39 and the resist roller pair 18 and is used in the above-described image formation. Incidentally, although not shown for convenience in the image forming apparatus 1 according to this embodiment, a known both sides conveying section is provided.

(Image Erasing Section 20)

The image erasing section 20 has a heating member composed of, as a first member which heats the paper for reuse P2 on the side where the toner image is formed (hereinafter also referred to as "on the image side"), a first heating roller 21 which has a diameter of 40 mm and has a halogen lamp 23 as a heating source in the inner side thereof, and as a second member which heats the paper for reuse P2 on the side opposite to the side where the toner image is formed (hereinafter also referred to as "on the pressing side"), a second heating roller 22 which has a diameter of 40 mm and has a halogen lamp 24 as a heating source in the same manner as the first heating roller 21 and is in press-contact with the first heating roller 21. A nip formed by the first heating roller 21 and the second heating roller 22 has a width of about 10.8 mm, and a nip passing time in the image erasing section 20 is about 0.08 sec.

Figure 4:
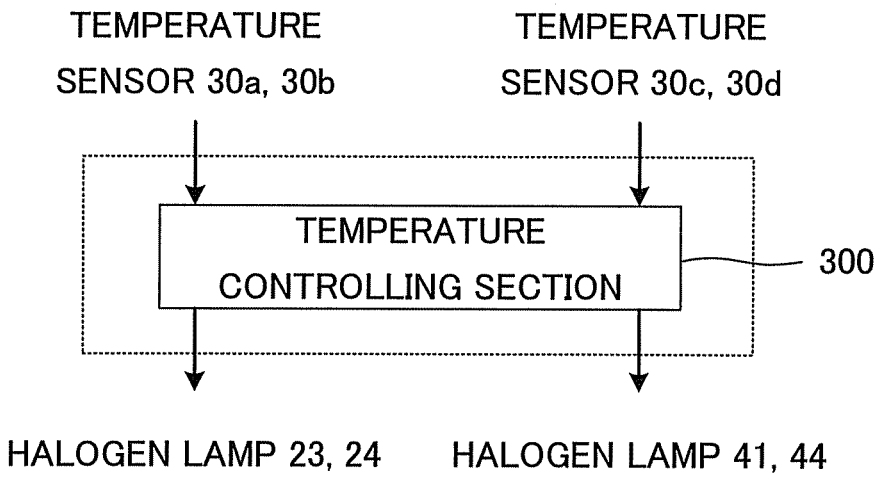
FIG. 4 is a schematic structural view of members involved in temperature control in FIG. 1.

The first heating roller 21 and the second heating roller 22 are provided with temperature sensors (thermistors) 30*a* and 30*b*, respectively, which measure the surface temperatures of the respective rollers. The temperature sensors 30*a* and 30*b* each output the detected information to a temperature controlling section 300. Based on the input information, the temperature controlling section 300 controls a current supplied to the halogen lamps 23 and 24 each serving as a heating source, and controls the surface temperatures of the first heating roller 21 and the second heating roller 22 to be a predetermined temperature (FIGS. 1 and 4). Here, the predetermined temperature is a temperature predetermined within a range between the decolorization initiation temperature of the decolorizable toner to be used and the high-temperature offset initiation temperature thereof. The predetermined temperature is determined arbitrarily in view of the decolorization stability and high-temperature offset of the decolorizable toner to be used. Further, from the same reason, it is preferred that the surface temperatures of the first heating roller 21 and the second heating roller 22 are set to substantially the same value. Specifically, for example, if a decolorizable toner having a decolorization initiation temperature of 90° C. is used, the surface temperatures of the first heating roller 21 and the second heating roller 22 are controlled to be 120° C.

Figure 2:
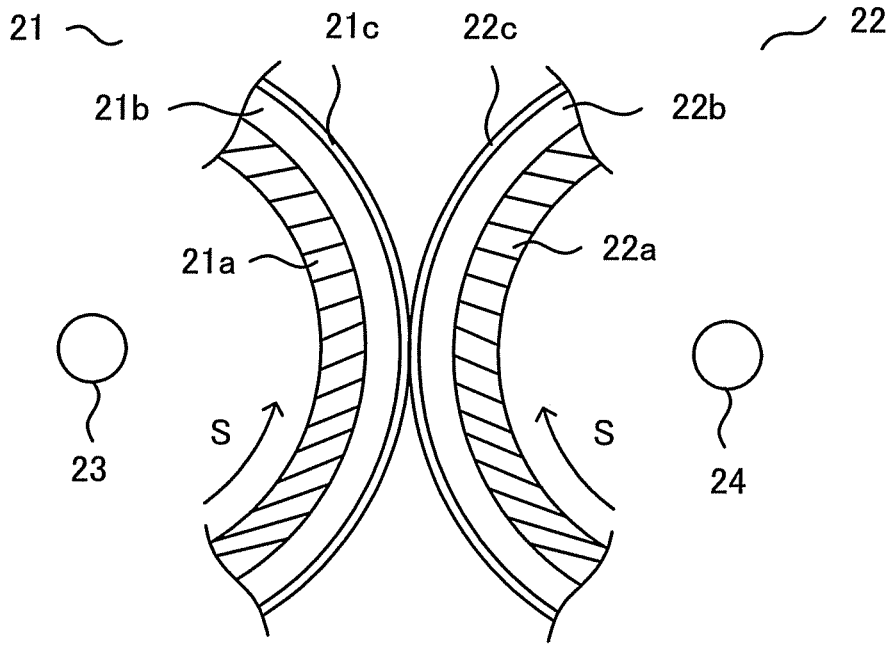
FIG. 2 is a partial cross-sectional view of a heating member of an image erasing section in FIG. 1.

FIG. 2 shows a partial cross-sectional view of the first and second members of the image erasing section 20 in FIG. 1. The first heating roller 21 serving as the first member which heats paper on the image side has a silicone rubber layer having a thickness of about 1.2 mm as an elastic layer 21*b* and a fluorocarbon resin PFA (a tetrafluoroethylene-perfluoroalkylvinylether copolymer) layer having a thickness of about 30 μm as a release layer 21*c* on a roller base body 21*a* made of aluminum and having a thickness of about 1.5 mm. The second heating roller 22 serving as the second member which heats paper on the pressing side has a silicone rubber layer having a thickness of about 1.2 mm as an elastic layer 22*b* and a fluorocarbon resin PFA layer having a thickness of about 30 μm as a release layer 22*c* on a roller base body 22*a* made of aluminum and having a thickness of about 1.5 mm in the same manner as the first heating roller 21. The first heating roller 21 is driven by a driving source, and the second heating roller 22 is driven by the first heating roller 21 (the arrow S in FIG. 2). Incidentally, the above elastic layer may be provided on the first member which heats paper on the image side. Accordingly, the embodiment in which the elastic layer is provided for both of the first member and the second member shown in FIG. 2 is particularly effective in, for example, the case where paper for reuse P2 having a toner image on one side is accommodated in the paper feeding section 33 regardless of whether the front surface or the back surface faces up, the case where paper for reuse P2 having a toner image formed on both surfaces is accommodated in the paper feeding section 33, or the like.

(Image Fixing Section 40)

The image fixing section 40 has, as a third member which heats the recording medium P on the side where an unfixed toner image is formed, a heating roller 42 which has a diameter of 45 mm and has a halogen lamp 41 as a heating source in the inner side thereof, as a fourth member which is in press-contact with the heating roller 42 and heats the recording medium P on the side opposite to the side where the toner image is formed, an endless pressing belt 43 which has a diameter of 47 mm and forms a nip such that the nip is wound around the heating roller 42, a belt heating roller 45 which has a diameter of 40 mm, has a halogen lamp 44 as a heating source in the inner side thereof, and heats the pressing belt 43 on the side of the entrance of the nip, a pressing roller 46 which has a diameter of 18 mm and presses the heating roller 42 via the pressing belt 43 on the side of the exit of the nip, a tension roller 47, and a pressing pad 49 which has a width of 10 mm and presses the heating roller 42 via the pressing belt 43 in a central part of the nip and is fixed by a pad holder 48. The nip formed by the heating roller 42 and the pressing belt 43 has a width of about 27 mm, and a nip passing time in the image fixing section 40 is about 0.2 sec.

Similar to the image erasing section 20, the heating roller 42 and the pressing belt 43 are provided with temperature sensors (thermistors) 30*c* and 30*d*, respectively, which measure the surface temperatures of the respective members. The temperature sensors 30*c* and 30*d* each output the detected information to a temperature controlling section 300. Based on the input information, the temperature controlling section 300 controls a current supplied to the halogen lamps 41 and 44 each serving as a heating source, and controls the surface temperatures of the heating roller 42 and the pressing belt 43 to be a predetermined temperature (FIGS. 1 and 4). Here, the predetermined temperature is a temperature predetermined within a range between the lower limit fixing temperature of the decolorizable toner to be used and the decolorization initiation temperature thereof. The predetermined temperature is determined arbitrarily in view of the decolorizing property and fixing property of the decolorizable toner to be used. Further, from the same reason, it is preferred that the surface temperatures of the heating roller 42 and the pressing belt 43 are set to substantially the same value. Specifically, for example, if a decolorizable toner having a decolorization initiation temperature of 90° C. is used, the surface temperatures of the heating roller 42 and the pressing belt 43 are controlled to be 73° C.

Figure 3:
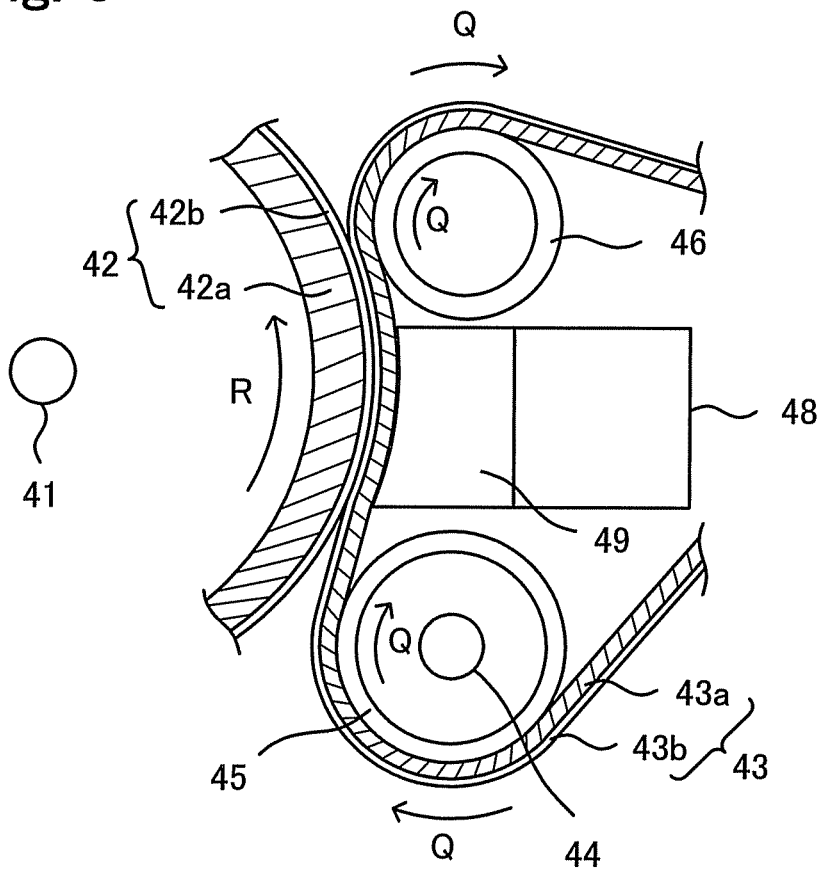
FIG. 3 is a partial cross-sectional view of a heating member of an image fixing section in FIG. 1.

FIG. 3 shows a partial cross-sectional view of the third and fourth members of the image fixing section 40 in FIG. 1. The heating roller 42 serving as the third member has a fluorocarbon resin PFA layer 42*b* having a thickness of about 25 μm as a release layer on a roller base body 42*a* made of aluminum and having a thickness of about 1.5 mm. On the other hand, the pressing belt 43 serving as the fourth member has a fluorocarbon resin PFA layer 43*b* having a thickness of about 30 μm as a release layer on a belt base body 43*a* made of nickel and having a thickness of about 40 μm. It is also possible to provide an elastic body (rubber) layer between the belt base body 43*a* and the release layer 43*b* of the pressing belt 43 on the pressing side. Incidentally, the heating roller 42 is driven by a driving source (not shown), and the pressing belt 43 is driven by the heating roller 42 (the arrows R and Q in FIG. 2).

Other Embodiments

The forms of the heating members of the image erasing section 20 and the image fixing section 40 in the image forming apparatus 1 according to this embodiment can be changed within a range that does not deviate from this embodiment. For example, in the case of the image erasing section 20, other than the combination of a roller with a roller as the combination of the first member with the second member described in the above embodiment, a combination of a belt with a roller, a belt with a belt, a roller with a belt, etc., can be adopted, and also in the case of the image fixing section 40, other than the combination of a roller with a belt as the combination of the third member (on the image fixing side) with the fourth member (on the pressing side) described in the above embodiment, a combination of a belt with a roller, a belt with a belt, a roller with a roller, etc. can be adopted.

In addition, other than the case where the image erasing section 20 to be provided in the image forming apparatus 1 is disposed between the paper feeding section 32 or 33 and the image forming section 10 in the paper conveying path described in this embodiment, the image forming apparatus may be configured such that the apparatus has an operation mode for performing only a decolorizing operation, and by designating the decolorizing operation mode, decolorization is performed by the image erasing section 20 and the paper having been subjected to decolorization is accommodated in a paper feed cassette.

Figure 6:
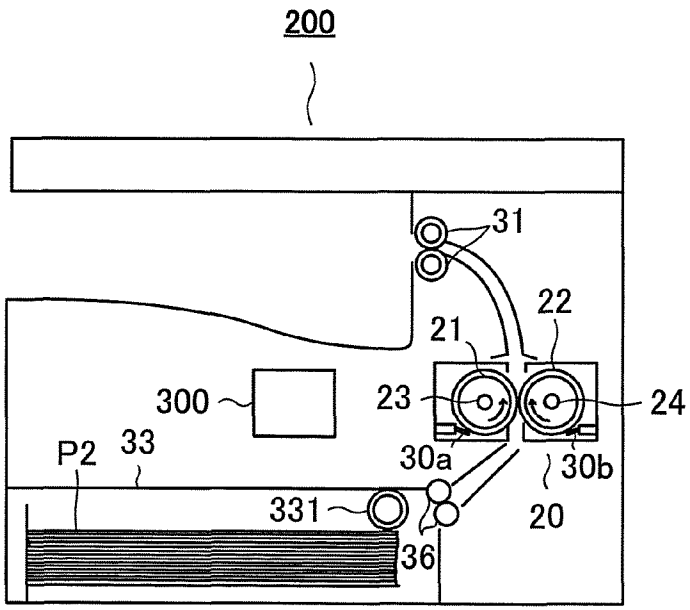
FIGS. 5 and 6 are each a schematic structural view of an image forming apparatus according to another embodiment.
Figure 5:
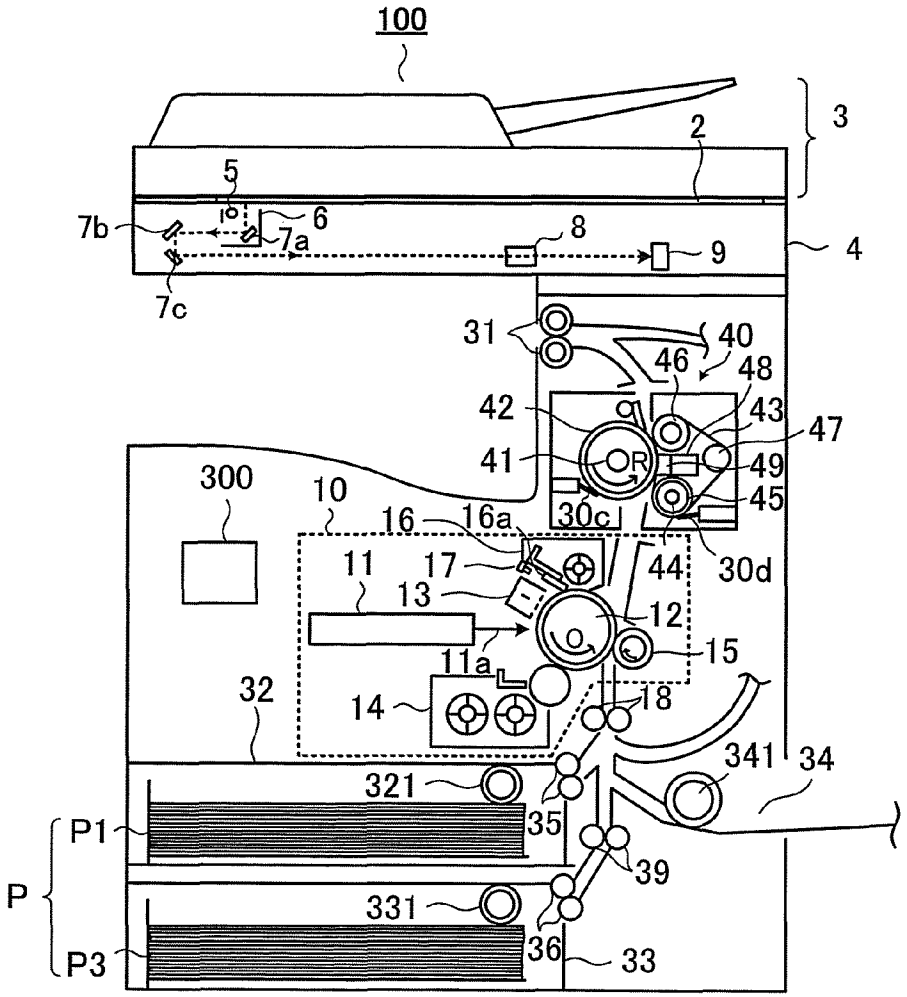

Further, as shown in FIGS. 5 and 6, even if the image erasing section 20 is not disposed in the image forming apparatus 1 and an image forming apparatus 100 and an image erasing apparatus 200 are provided separately, the effect of this embodiment can be sufficiently obtained. In a paper feeding section 33 of the image forming apparatus 100, paper P3 which is obtained by erasing the toner image on the paper for reuse P2 is accommodated. As an example of employing such an embodiment, for example, by installing a plurality of image erasing apparatuses 200 other than the image forming apparatus 1 or the image forming apparatus 100 in an office, paper having a fixed toner image obtained by printing by the image forming apparatus 1 or the image forming apparatus 100 can be efficiently recycled.

Hereinafter, the image forming apparatus according to this embodiment will be more specifically described by showing Examples. Incidentally, in the following description, "part (s)" and "%" are on a mass basis unless otherwise specified.

(Preparation of Decolorizable Toner)

As a decolorizable toner to be used in the evaluation for fixing property and decolorizing property, a capsule-type thermally decolorizable toner prepared by the following chemical method was used.

[1] Preparation of Finely Pulverized Binder Resin Liquid

As a binder resin, a Pes (polyester) resin having a glass transition point (Tg) of 50° C. and a softening point (Ts) of 100° C. was used. A finely pulverized binder resin liquid was prepared with a high-pressure homogenizer using 30 parts of the Pes resin, 3 parts of an anionic emulsifying agent (Neopelex G-15 manufactured by Kao Corporation), and 0.6 parts of a neutralizing agent (dimethylaminoethanol).

[2] Preparation of Finely Pulverized Wax Liquid

A finely pulverized wax liquid was prepared using 30 parts of rice wax in the same manner as in the case of the above binder resin.

[3] Preparation of Encapsulated Color Material 1 part of 3-(2-ethoxy-4-diethylaminophenyl)-3-(1-ethyl-2-methylindol-3-yl)-4-azaphthalide as a leuco dye, 5 parts of 2,2-bis(4-hydroxyphenyl) hexafluoropropane as a color developing agent, and 50 parts of a diester compound of pimelic acid with 2-(4-benzyloxyphenyl)ethanol as a temperature control agent were mixed and dissolved by heating.

In the components dissolved by heating, 20 parts of an aromatic polyvalent isocyanate prepolymer and 40 parts of ethyl acetate were mixed as encapsulating agents. The resulting mixed solution was poured into 250 parts of an aqueous solution of 8% polyvinyl alcohol, and the resulting mixture was emulsified and dispersed. After stirring was continued at 70° C. for about 1 hour, 2 parts of a water-soluble aliphatic modified amine was added thereto as a reaction agent, and stirring was further continued for about 3 hours while maintaining the temperature of the liquid at 90° C., whereby colorless encapsulated color material was obtained.

Further, the resulting encapsulated color material was placed in a freezer (−30° C.) to develop a color, whereby a blue color material was obtained. The volume average particle diameter of this color material was measured using SALD-7000 manufactured by Shimadzu Corporation and found to be 2 μm. The thus obtained color material has a property that the decolorization is initiated at 85° C. and the color is completely erased at 95° C.

[4] Preparation of Toner 283 parts of the finely pulverized binder resin liquid prepared in the above [1], 17 parts of the finely pulverized wax liquid prepared in the above [2], and 10 parts of the encapsulated color material prepared in the above [3] were aggregated at 45° C. using 100 parts of an aqueous solution of 5% aluminum sulfate [$Al_2(SO_4)_3$]. Then, the temperature of the mixture was raised to 65° C. at a temperature raising speed of 1° C./min to fuse the aggregated particles, followed by washing and drying, whereby a toner was obtained. The amount of the encapsulated color material in the thus obtained toner was 10%.

To the obtained toner, an external additive was added appropriately. The resulting toner is hereinafter referred to as a capsule-type decolorizable toner A. Incidentally, the true specific gravity of the capsule-type decolorizable toner A is in a range of from about 0.9 to 1.2 g/cm$^3$. Further, as for the decolorizing property of the capsule-type decolorizable toner A, since the above-prepared color material is used, the decolorization is initiated at 85° C. and the color is completely erased at 95° C.

(Evaluation of Fixing Property)

The fixing property was evaluated using the capsule-type decolorizable toner A prepared by the above method.

First, in the image forming apparatus 1, an image forming operation was performed and an unfixed toner image was formed on unused paper P1. Then, the formed unfixed toner image was fixed by operating the image fixing section 40.

Figure 7:
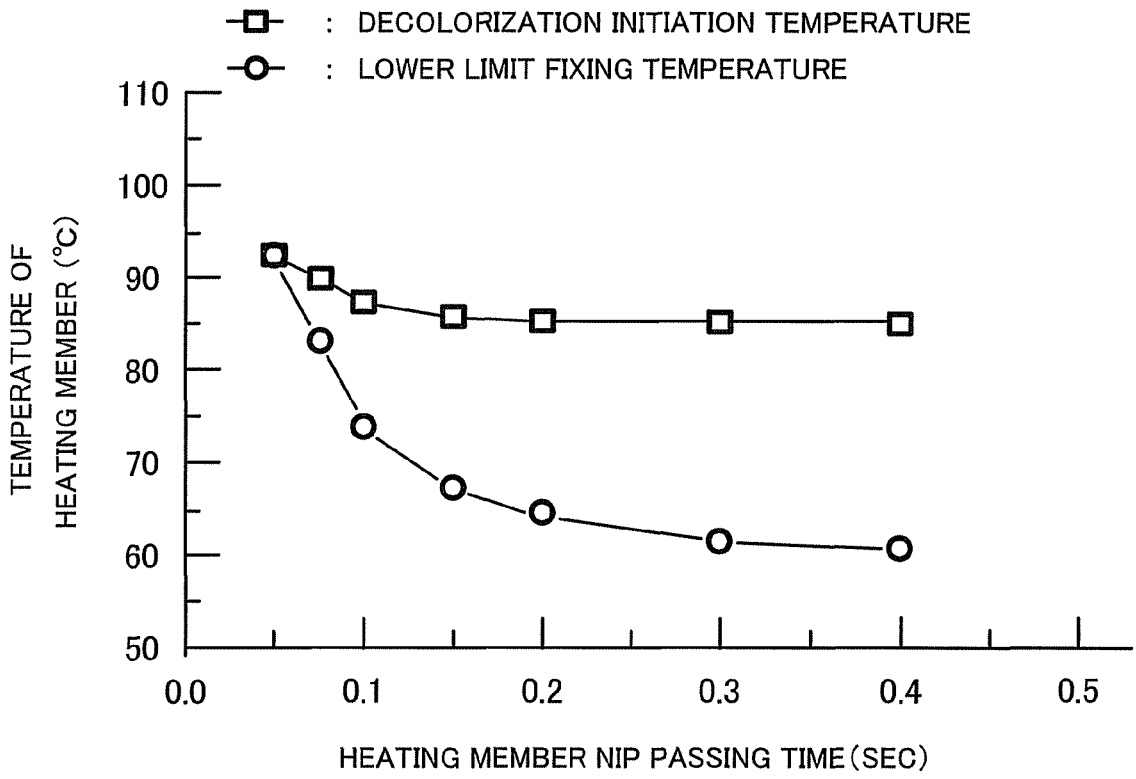
FIG. 7 is a graph showing a relationship between a lower limit fixing temperature or a decolorization initiation temperature and a heating member nip passing time in an image fixing section in FIG. 1.

FIG. 7 shows the lower limit fixing temperature of an unfixed toner image on conveyed paper and the decolorization initiation temperature according to the nip passing time by changing the paper conveying speed and the controlled temperature in the image fixing section 40. Incidentally, the temperatures of the heating roller 42 (on the image side) serving as the third member and the pressing belt 43 (on the pressing side) serving as the fourth member are controlled to be the same. Further, the heating roller 42 and the pressing belt 43 are not provided with an elastic layer.

As shown in FIG. 7, the lower limit fixing temperature strongly depends on the heating member nip passing time, and it is found that for performing fixing at a low temperature, a nip passing time of 0.15 sec or more is required (O in FIG. 7). On the other hand, the decolorization initiation temperature is almost not affected by the heating member nip passing time, and it is found that the dependency of the decolorization initiation temperature on the heating member nip passing time is low (□ in FIG. 7).

It is necessary that the temperatures of the third member and the fourth member of the image fixing section 40 should be controlled to be in a temperature range in which a toner image can be fixed without decolorizing the image, that is, between the lower limit fixing temperature and the decolorization initiation temperature (including a variation depending on location).

As shown in FIG. 7, as the heating member nip passing time is increased, a difference between the decolorization initiation temperature and the lower limit fixing temperature is increased. For example, when the heating member nip passing time is 0.2 sec, the temperature difference is 20° C., and a controlled temperature range which can be put to practical use is obtained. Incidentally, it is important that in order to realize fixing at a low temperature, both members on the image side and on the pressing side be heated. Further, if an unfixed toner image is formed on both surfaces of paper, it is necessary that a fixed toner image on a first surface (front surface) be not decolorized by the heating member on the pressing side when an unfixed toner image on a second surface (back surface) is fixed, and it is important that the temperatures of the members on the image fixing side and on the pressing side be controlled to be the same.

Subsequently, by using the above-described fixing method, the fixing property of an unfixed toner image was evaluated for the presence or absence of an elastic layer in each of the heating roller 42 and the pressing belt 43. The combination of the presence or absence of an elastic layer is shown in Table 1.

TABLE 1

| Combination of Presence or Absence of Elastic Layer in Image Fixing Section 40 | | |
|---|---|---|
| | Elastic layer | |
| Example | Image side (heating roller 42) | Pressing side (pressing belt 43) |
| 1 | Absence | Absence |
| 2 | Absence | Presence |
| 3 | Presence | Absence |
| 4 | Presence | Presence |

Figure 8:
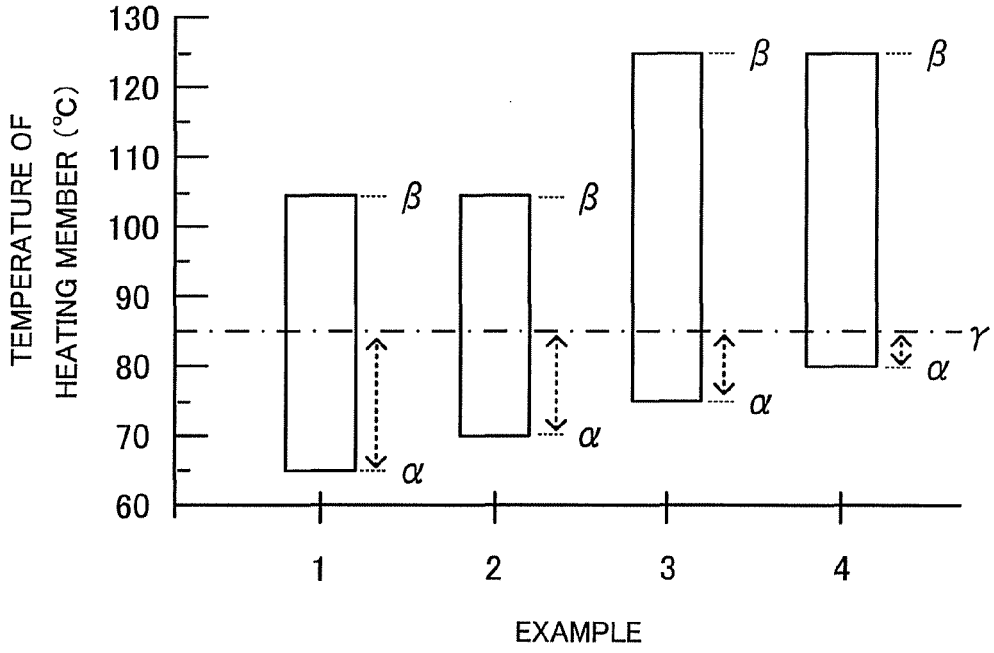
FIG. 8 is a graph showing evaluation results of fixing property for the presence or absence of an elastic layer in a heating member of an image fixing section in FIG. 1.

The fixing property was evaluated for four combinations as shown in Table 1: the case where an elastic layer was not provided between the base body and the release layer for both of the heating roller 42 and the pressing belt 43 (Example 1), the case where an elastic layer was provided only for the pressing belt 43 (Example 2), the case where an elastic layer was provided only for the heating roller 42 (Example 3), and the case where an elastic layer was provided for both of the heating roller 42 and the pressing belt 43 (Example 4). Incidentally, in the case of the heating roller 42, the elastic layer provided was made of silicone rubber having a thickness of 0.8 mm, and in the case of the pressing belt 43, the elastic layer provided was made of silicone rubber having a thickness of 0.2 mm. The evaluation results are shown in FIG. 8. Incidentally, in FIG. 8, the lower limit (α) indicates the lower limit fixing temperature, the upper limit (β) indicates the initiation temperature of high-temperature offset (transfer of the toner onto the heating member), and the alternate long and short dash line (γ) indicates the decolorization initiation temperature (85° C.) of the capsule-type decolorizable toner A. Further, the heating member nip passing time in the image fixing section 40 was set to 0.2 sec.

As shown in FIG. 8, it is found that when the elastic layer is not provided for the heating roller 42 which is disposed on the image side, the lower limit fixing temperature is low (Examples 1 and 2 in FIG. 8), a sufficient temperature difference can be ensured with respect to the decolorization initiation temperature (85° C.) of the decolorizable toner used. In particular, when the elastic layer is not provided for both of the heating roller 42 and the pressing belt 43, the lower limit fixing temperature is the lowest (Example 1 in FIG. 8) Further, it is found that when the elastic layer is provided for the heating roller 42, the lower limit fixing temperature is significantly increased and also the upper limit fixing temperature, that is, the high-temperature offset initiation temperature is increased (Examples 3 and 4 in FIG. 8).

<Evaluation of Decolorizing Property>

The decolorizing property when decolorization was performed by the image erasing section 20 was evaluated using paper P2 having a fixed toner image obtained by the image fixing section 40.

First, the decolorizing property of a fixed toner image was evaluated for a combination of the presence or absence of an elastic layer in each of the first heating roller 21 (first member) and the second heating roller 22 (second member) of the image erasing section 20 using paper P2 having a fixed toner image by operating the image erasing section 20 in which the heating roller on the image side served as the first heating roller 21. The combination of the presence or absence of an elastic layer is shown in Table 2.

TABLE 2

| Combination of Presence or Absence of Elastic Layer in Image Erasing Section 20 | | |
|---|---|---|
| | Elastic layer | |
| Example | Image side (first heating roller 21) | Pressing side (second heating roller 22) |
| 5 | Absence | Absence |
| 6 | Absence | Presence |
| 7 | Presence | Absence |
| 8 | Presence | Presence |

Figure 9:
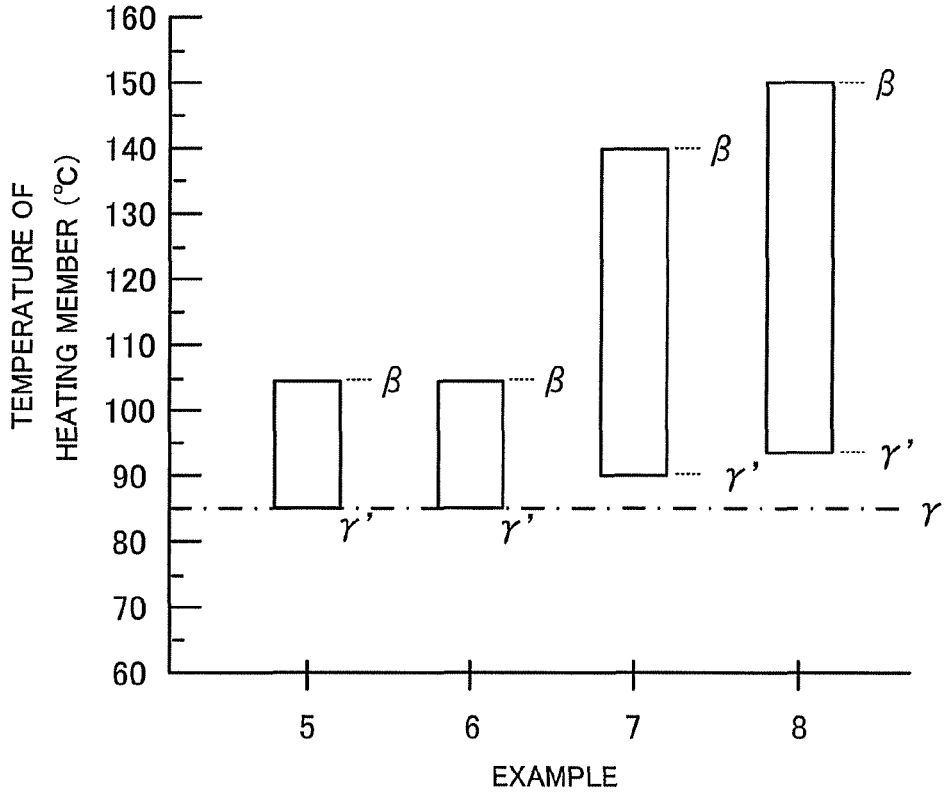
FIGS. 9 and 10 are each a graph showing evaluation results of decolorizing property for the presence or absence of an elastic layer in a heating member of an image erasing section in FIG. 1.

The decolorizing property was evaluated for four combinations as shown in Table 2: the case where an elastic layer was not provided for both of the first heating roller 21 and the second heating roller 22 (Example 5), the case where an elastic layer was provided only for the second heating roller 22 (Example 6), the case where an elastic layer was provided only for the first heating roller 21 (Example 7), and the case where an elastic layer was provided for both of the first heating roller 21 and the second heating roller 22 (Example 8). The elastic layers provided for the first heating roller 21 and the second heating roller 22 were each made of silicone rubber having a thickness of 1.2 mm. The evaluation results are shown in FIG. 9. Incidentally, in FIG. 9, the lower limit indicates the decolorization initiation temperature (γ'), the upper limit indicates the high-temperature offset initiation temperature (β), and the alternate long and short dash line (γ) indicates the decolorization initiation temperature (85° C.) of the capsule-type decolorizable toner A. Further, the nip passing time in the image erasing section 20 was set to 0.08 sec.

As described above, in the image erasing section 20, it is important that a difference between the temperature at which decolorization is actually initiated (γ') and the high-temperature offset initiation temperature (β) of a fixed image be as large as possible. As shown in FIG. 9, it is found that by providing the elastic layer for the first heating roller 21 serving as the heating member on the image side, the high-temperature offset initiation temperature is increased to widen the temperature range enabling the decolorization (Examples 7 and 8 in FIG. 9).

Subsequently, the decolorizing property of a fixed toner image was evaluated for a combination of the presence or absence of an elastic layer in each of the first heating roller 21 and the second heating roller 22 of the image erasing section 20 using paper P2 having a fixed toner image by operating only the image erasing section 20 in which the heating roller on the image side served as the second heating roller 22. The combination of the presence or absence of an elastic layer is shown in Table 3.

TABLE 3

| Combination of Presence or Absence of Elastic Layer in Image Erasing Section 20 | | |
|---|---|---|
| | Elastic layer | |
| Example | Pressing side (first heating roller 21) | Image side (second heating roller 22) |
| 9 | Absence | Absence |
| 10 | Absence | Presence |
| 11 | Presence | Absence |
| 12 | Presence | Presence |

Figure 10:
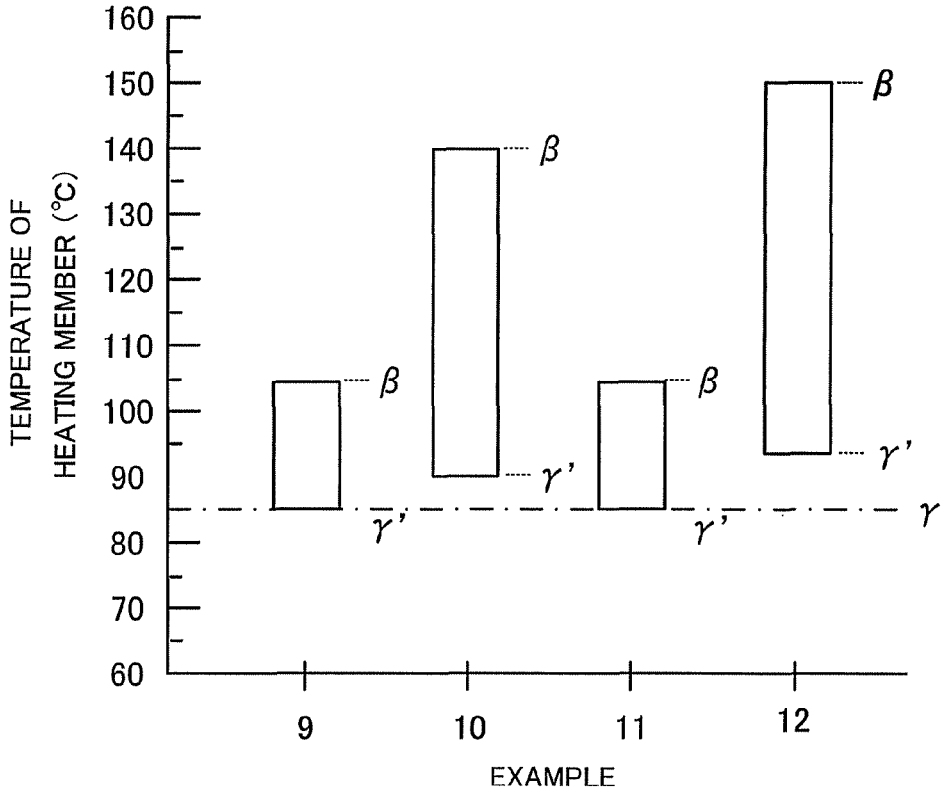

The decolorizing property was evaluated for four combinations as shown in Table 3: the case where an elastic layer was not provided for both of the first heating roller 21 and the second heating roller 22 (Example 9), the case where an elastic layer was provided only for the second heating roller 22 (Example 10), the case where an elastic layer was provided only for the first heating roller 21 (Example 11), and the case where an elastic layer was provided for both of the first heating roller 21 and the second heating roller 22 (Example 12). The elastic layers provided for the first heating roller 21 and the second heating roller 22 were each made of silicone rubber having a thickness of 1.2 mm. The evaluation results are shown in FIG. 10. Incidentally, in FIG. 10, the lower limit indicates the decolorization initiation temperature (γ') the upper limit indicates the high-temperature offset initiation temperature (β), and the alternate long and short dash line (γ) indicates the decolorization initiation temperature (85° C.) of the capsule-type decolorizable toner A. Further, the nip passing time in the image erasing section 20 was set to 0.08 sec.

As shown in FIG. 10, it is found that by providing the elastic layer for the second heating roller 22 serving as the heating member on the image side, the high-temperature offset initiation temperature is increased to widen the temperature range enabling the decolorization (Examples 10 and 12 in FIG. 10).

As shown in FIGS. 9 and 10, when decolorization is performed for both surfaces, the elastic layer is provided for both of the first heating roller 21 and the second heating roller 22 (Example 8 in FIG. 9 and Example 12 in FIG. 10).

Subsequently, the image erasing section 20 in which the thicknesses of the elastic layers in the first heating roller 21 and the second heating roller 22 of the image erasing section 20 were changed was operated to decolorize a fixed toner image, and evaluation was performed for the decolorization initiation temperature and the high-temperature offset initiation temperature with respect to the thickness of the elastic layer. The evaluation results are shown in FIG. 11.

Figure 11:
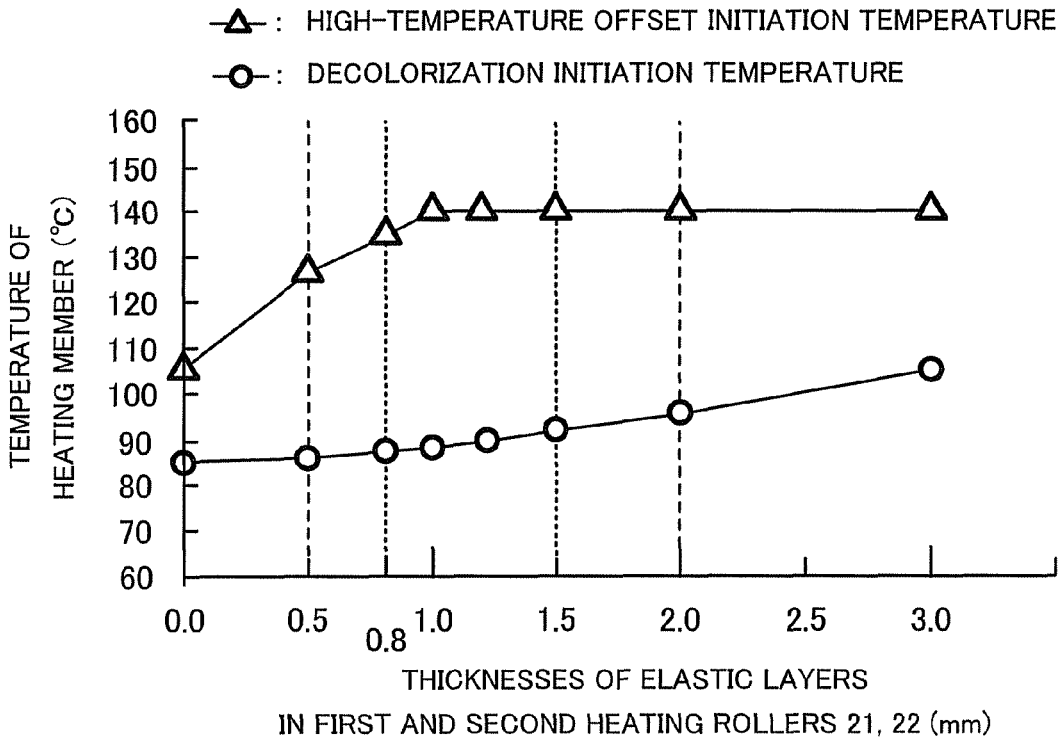
FIG. 11 is a graph showing a relationship between the thickness of an elastic layer in a heating member of an image erasing section in FIG. 1 and a decolorization initiation temperature or a high-temperature offset initiation temperature.

FIG. 11 shows the decolorization initiation temperature and the high-temperature offset initiation temperature with respect to the thicknesses of the elastic layers 21*b* and 22*b* in the first heating roller 21 and the second heating roller 22 of the image erasing section 20. The temperatures of the first heating roller 21 and the second heating roller 22 serving as a heating member are controlled to be substantially the same. As shown in FIG. 11, as the thicknesses of the elastic layers 21*b* and 22*b* are increased, the decolorization initiation temperature is increased. On the other hand, the high-temperature offset initiation temperature is increased until a certain thickness is reached, beyond which the high-temperature offset initiation temperature becomes constant. Therefore, the range of the thicknesses of the elastic layers 21*b* and 22*b* in which a difference between the decolorization initiation temperature and the high-temperature offset initiation temperature is large is preferably from 0.5 to 2 mm, more preferably from 0.8 to 1.5 mm.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions the accompanying claims and their equivalents are intended to cover such forms or modifications as would fall within the scope and spirit of the inventions.

What is claimed is:

1. An image forming apparatus comprising:

an image erasing section including a first member which has a rubber layer and heats a recording medium having a thermally decolorizable toner image on the toner image side and a second member which forms a nip together with the first member and erases the toner image by allowing the recording medium to pass through the nip in cooperation with the first member;

an image forming section which transfers a thermally decolorizable toner image onto the recording medium on which the toner image is erased to form an unfixed toner image; and an image fixing section including a third member which does not have a rubber layer and heats the recording medium on the unfixed toner image side and a fourth member which forms a nip together with the third member and fixes the unfixed toner image by allowing the recording medium to pass through the nip in cooperation with the third member, a nip passing time of the recording medium in the image fixing section being longer than that in the image erasing section.

2. The apparatus according to claim 1, wherein the fourth member does not have an elastic layer.

3. The apparatus according to claim 1, wherein the third member has a base body and a release layer provided on the base body.

4. The apparatus according to claim 2, wherein the fourth member has a base body and a release layer provided on the base body.

5. The apparatus according to claim 1, wherein the first member has a base body, an elastic layer provided on the base body, and a release layer provided on the elastic layer.

6. The apparatus according to claim 1, wherein the second member has a base body, an elastic layer provided on the base body, and a release layer provided on the elastic layer.

7. The apparatus according to claim 1, wherein the elastic layer in the first member has a thickness of from about 0.5 to 2.0 mm.

8. The apparatus according to claim 1, wherein the surface temperatures of the third member and the fourth member are lower than those of the first member and the second member.

9. The apparatus according to claim 1, wherein the surface temperatures of the third member and the fourth member are controlled to be substantially the same.

10. The apparatus according to claim 1, wherein the surface temperatures of the first member and the second member are controlled to be substantially the same.

11. The apparatus according to claim 1, wherein a paper feeding section which accommodates a recording medium having a fixed toner image and conveys the recording medium to the image forming section is provided on the upstream of the image erasing section in a conveying path of the recording medium.

12. An image forming and erasing method comprising: allowing a recording medium having a thermally decolorizable toner image to pass through a nip formed by a first member which has a rubber layer and heats the recording medium on the toner image side and a second member which is in press-contact with the first member to erase the toner image;

transferring a thermally decolorizable toner image onto the recording medium on which the toner image is erased to form an unfixed toner image; and allowing the recording medium to pass through a nip formed by a third member which does not have a rubber layer and heats the recording medium on the unfixed toner image side and a fourth member which is in press-contact with the third member to fix the unfixed toner image, taking time longer than the nip formed by the first member and the second member passing time of the recording medium.

13. The method according to claim 12, wherein the fourth member does not have an elastic layer.

14. The method according to claim 13, wherein the third member has a base body and a release layer provided on the base body.

15. The method according to claim 13, wherein the fourth member has a base body and a release layer provided on the base body.

16. The method according to claim 14, wherein the first member has a base body, an elastic layer provided on the base body, and a release layer provided on the elastic layer.

17. The method according to claim 15, wherein the surface temperatures of the third member and the fourth member are lower than those of the first member and the second member.

* * * * *